US008852353B2

(12) United States Patent
Oberlander

(10) Patent No.: US 8,852,353 B2
(45) Date of Patent: Oct. 7, 2014

(54) SOLID DISHMACHINE DETERGENT NOT REQUIRING A SEPARATE RINSE ADDITIVE

(76) Inventor: Michael Oberlander, Kansas City, MO (US)

( * ) Notice: Subject to any disclaimer, the term of this patent is extended or adjusted under 35 U.S.C. 154(b) by 772 days.

(21) Appl. No.: 12/332,048

(22) Filed: Dec. 10, 2008

(65) Prior Publication Data

US 2010/0139705 A1 Jun. 10, 2010

(51) Int. Cl.

| | |
|---|---|
| ***B08B 3/04*** | (2006.01) |
| ***C11D 17/00*** | (2006.01) |
| ***C11D 3/37*** | (2006.01) |

(52) U.S. Cl.

CPC ..... *C11D 3/3769* (2013.01); *C11D 17/0073* (2013.01)

USPC ..... 134/25.2

(58) Field of Classification Search

USPC ..... 134/26, 42, 25.2; 510/504

See application file for complete search history.

(56) References Cited

U.S. PATENT DOCUMENTS

| | | | | |
|---|---|---|---|---|
| RE32,763 | E * | 10/1988 | Fernholtz et al. | 510/225 |
| 5,932,531 | A | 8/1999 | Oberlander et al. | |
| 5,981,463 | A | 11/1999 | Oberlander et al. | |
| 6,593,288 | B2 * | 7/2003 | Aubay et al. | 510/504 |
| 6,664,218 | B1 | 12/2003 | Dastbaz et al. | |
| 7,026,276 | B2 * | 4/2006 | Kessler et al. | 510/220 |
| 2006/0270579 | A1 * | 11/2006 | Aubay et al. | 510/218 |
| 2007/0149431 | A1 * | 6/2007 | Lentsch et al. | 510/201 |

FOREIGN PATENT DOCUMENTS

| | | |
|---|---|---|
| WO | WO 97/16598 | 5/1997 |

OTHER PUBLICATIONS thermPhos, Dequest 2000 Product Information, www.dequest.com/Products/Dequest/Dequest_2000/Dequest_2000.aspx, 9 pages.

Acusol™ 445N by Rohm and Haas—chemidex.com, Household, Industrial & Institutional Cleaners, www.chemidex.com/en/NA/Hlandl/Detail/1540/53421/ACUSOL™—445N, 2 pages.

Chesham Speciality Ingredients, Formulation Chemicals Division, Acusol Range, www.cheshamchemicals.co.uk/indrustrial/forchem/products/acusol.htm, 2 pages.

Power-Kleen Titration Kit, Mart Tech Services, www.marttechservices.com, 2 pages.

Rhodia Novecare, www.rhodia-novecare.com/hpcii/register_form_step_1.jsp, 1 page.

* cited by examiner

*Primary Examiner* — Michael Kornakov
*Assistant Examiner* — Douglas Lee
(74) *Attorney, Agent, or Firm* — Hovey Williams LLP

(57) ABSTRACT

New solid detergent compositions and methods of forming and using those compositions are provided. The compositions for forming the solid detergents comprise a copolymer, scale inhibiting agent, and non-phosphate builder dispersed or dissolved in a solvent system. Advantageously, the inventive solid detergents provide dramatically improved cleaning performance and drying time without the use of a separate rinse additive. The detergents are especially suited to commercial dishmachine processes. The solid detergents are also in the form of a solid, homogeneous, self-sustaining body for improved handling and use.

9 Claims, No Drawings

SOLID DISHMACHINE DETERGENT NOT REQUIRING A SEPARATE RINSE ADDITIVE

BACKGROUND OF THE INVENTION

1. Field of the Invention

The present invention is broadly concerned with new solid detergent compositions that provide a spot-free clean without the use of a separate rinse additive or agent. The invention is also concerned with methods of using those compositions.

2. Description of the Prior Art

Adequate cleaning of serviceware (e.g., glassware, flatware, plates, bowls, etc.) in restaurants is necessary to ensure the safety of the food and beverages supplied to consumers. Solid and liquid detergents for automatic dishwashers, and specifically commercial dishmachines must be capable of effectively removing food soils and residue. Another important criterion is the visual appearance of the serviceware alter cleaning. That is, even if the serviceware has been completely cleared of food residues, it will not be acceptable to consumers if there are spots, hazing, and/or a film on the surface. Hard water deposits often leave spots or a film, and the detergent itself may leave behind a residue or film. Ineffective detergents can also leave behind lipstick and other similar types of greasy substances. Although such wares have been cleaned of soils, they do not appear clean. To address these issues, as well as decrease drying time, many detergents require the use of a separate rinse aid or rinse additive.

Traditionally, commercial dishmachine processes comprise at least two cycles, a wash and a rinse cycle, but they can also include additional cycles such as pre-wash cycles, pre-rinse cycles, and drying cycles. In commercial dishmachines, liquid or solid detergent is automatically metered into the wash water during the wash cycle. The rinse additives are then automatically injected into the rinse water during the last few seconds or minutes of the rinse cycle to help water run off the serviceware as completely as possible, so that the various surfaces at the end of the wash program are quick to dry, residue-free, and sparkling.

Commercial establishments must continuously monitor and refill rinse additive levels, increasing the overall time and cost involved in the warewashing process. It would be beneficial if the rinse additive could be eliminated from the dishmachine process all together, while still achieving the benefits of a separate rinse additive. Thus, it is an object of the present invention to provide a detergent that does not require a separate rinse additive, and provides residue-free, quick-drying, sparkling serviceware when used in dishmachine. It is also an objective to provide a solid detergent for improved handling that provides dramatically improved cleaning performance over existing detergents.

SUMMARY OF THE INVENTION

The present invention overcomes the problems inherent in prior art detergents by providing a solid detergent that provides increased cleaning performance, but does not require the use of a separate rinse additive or agent.

In one embodiment there is provided a solid detergent composition in the form of a self-sustaining body. The composition comprises a scale inhibiting agent, a non-phosphate builder, and a copolymer of a quaternary ammonium compound and a comonomer selected from the group consisting of acids, acrylamides, and combinations thereof.

In another embodiment, there is provided a method of removing soils from a substrate surface. The method comprises providing a substrate having a surface with soils thereon; dissolving or dispersing a detergent composition in water to form a wash solution, where the detergent composition is in the form of a self-sustaining body and comprises a scale inhibiting agent, a non-phosphate builder, and a copolymer of a quaternary ammonium compound and a comonomer selected from the group consisting of acids, acrylamides, and combinations thereof. The method further comprises contacting the substrate surface with said wash solution, removing the soils from the substrate surface, and rinsing the substrate without the use of a separate rinse additive.

In a further embodiment, there is provided a method of forming a solid detergent composition. The method comprises forming a mixture comprising a scale inhibiting agent, a non-phosphate builder, and a copolymer, and allowing the mixture to harden to form a solid, self-sustaining body. The copolymer comprises a quaternary ammonium compound and a comonomer selected from the group consisting of acids, acrylamides, and combinations thereof.

In yet a further embodiment, there is provided a detergent composition comprising builders and surfactants, the improvement being that the composition comprises a copolymer of a quaternary ammonium compound and a comonomer selected from the group consisting of acids, acrylamides, and combinations thereof, and the composition is in the form of a self-sustaining body.

DETAILED DESCRIPTION OF THE PREFERRED EMBODIMENTS

The present invention is broadly concerned with inventive solid detergents in the form of a self-sustaining body and methods of using those detergents to clean serviceware. The solid detergents are formed from a composition comprising a copolymer, a scale inhibiting agent, and a non-phosphate builder dispersed or dissolved in a solvent system.

In more detail, the composition preferably comprises from about 0.01% to about 15% by weight of a copolymer, more preferably from about 0.1% to about 10% by weight, and even more preferably from about 0.5 to about 5% by weight, based upon the total weight of the composition taken as 100% by weight. Suitable copolymers for use in the inventive detergent compositions are preferably amphoteric, and more preferably, comprise a copolymer of a quaternary ammonium compound and a comonomer selected from the group consisting of acids, acrylamides, and combinations thereof. A preferred quaternary ammonium compound is a quaternary ammonium halide, and is more preferably, diallyl dimethyl ammonium chloride ("DADMAC"). Preferred acids are selected from the group consisting of acrylic acid, methacrylic acid, maleic acid, sulfonic acid, and the ammonium and alkali metal salts thereof. The copolymers are preferably formed from the polymerization of the quaternary ammonium compound with one or more of the acids listed above and acrylamide, if present. Particularly preferred copolymers for use in the present invention are selected from the group consisting of DADMAC/maleic acid copolymers, DADMAC/acrylic acid/acrylamide copolymers, DADMAC/sulfonic acid copolymers, and combinations thereof. More preferably, the copolymer is a surface modifying compound such as those disclosed in U.S. Pat. No. 6,593,288, incorporated by reference herein. Such copolymers are also commercially available under the name Mirapol® Surf-S, from Rhodia, Cranbury, N.J. A particularly preferred copolymer is Mirapol® Surf-S 210 (an acrylic acid-based DADMAC/acrylamide copolymer).

The solid detergent composition also preferably comprises a scale inhibiting agent. The term "scale inhibiting agent" is used herein to generally cover the sequestering or chelating of metal ions that results in the prevention and/or removal of scale. Thus, suitable scale inhibiting agents include sequestrants and chelating agents selected from the group consisting of phosphonic acid sequestrants, low molecular weight non-crosslinked polyacrylates, nitrilotriacetic acid, citric acid, phosphate builders (e.g., orthophosphates, polyphosphates, phosphonates, pyrophosphates, and metaphosphates), and the water-soluble salts thereof, and combinations thereof. As used herein, the term "water-soluble salts" is used to refer to alkali metal salts, such as potassium or sodium salts, or ammonium or substituted ammonium salts. The total level of scale inhibiting agent utilized in the composition is preferably from about 1 to about 50% by weight scale inhibiting agent, more preferably from about 5 to about 40% by weight, and even more preferably from about 10 to about 32% by weight, based upon the total weight of the composition taken as 100% by weight. A particularly preferred phosphonic acid sequestrant for use in the present composition is amino tri(methylene phosphonic acid), commercially available under the name DEQUEST® 2000, from Thermphos Trading GmbH, Switzerland. When present, the composition preferably comprises from about 0.01 to about 10% by weight phosphonic acid sequestrant, more preferably from about 0.1 to about 5% by weight, and even more preferably from about 1 to about 2% by weight, based upon the total weight of the composition taken as 100% by weight.

As used herein, the term "low molecular weight polyacrylates" refers to polyacrylate copolymers and homopolymers with a weight average molecular weight of less than about 10,000 Daltons, preferably less than about 7,000 Daltons, and more preferably from about 4,000 to about 5,000 Daltons. Water-soluble salts of acrylic acid and methacrylic acid homopolymers are particularly preferred for the low molecular weight polyacrylate and are available from Rohm and Haas under the ACUSOL™ brand. A most preferred low molecular weight polyacrylate is ACUSOL™ 445N, a sodium polyacrylate homopolymer, which has a molecular weight of about 4,500 Daltons. When present, the low molecular weight polyacrylates and salts thereof are preferably utilized in the composition at a level of from about 0.01 to about 20% by weight, more preferably from about 0.1 to about 10% by weight, and even more preferably from about 1 to about 5% by weight, based upon the total weight of the composition taken as 100% by weight.

Nitrilotriacetic acid chelating agents and the water-soluble salts thereof can also be used in the compositions. A particularly preferred nitrilotriacetic acid chelating agent is sodium nitrilotriacetate monohydrate NTA powder, available from Solutia, Inc., St. Louis, Mo. When present, the nitrilotriacetic acid is preferably utilized in the composition at a level of from about 0.1 to about 40% by weight, more preferably from about 1 to about 30% by weight, and even more preferably from about 10 to about 20% by weight, based upon the total weight of the composition taken as 100% by weight.

Citric acid, when present, is preferably included in the composition as sodium citrate. When present, the composition preferably comprises from about 0.1 to about 40% by weight citric acid and the salts thereof, more preferably from about 1 to about 30% by weight, and even more preferably from about 5 to about 20% by weight, based upon the total weight of the composition taken as 100% by weight.

Suitable phosphates for use in the inventive detergent are preferably alkali metal phosphates, such as those selected from the group consisting of sodium or potassium tripolyphosphate (either anhydrous or hydrated), sodium or potassium trimetaphosphate, tetrasodium or tetrapostassium pyrophosphate, sodium or potassium hexametaphosphate, trisodium or tripotassium orthophosphate, and combinations thereof, with sodium tripolyphosphate and/or tetrasodium pyrophosphate being particularly preferred. Such phosphates are available from Haifa Chemicals, Altamonte Springs, Fla. The phosphates are preferably present in the inventive detergent composition at a level of from about 1 to about 50% by weight phosphate, more preferably from about 5 to about 40% by weight, and even more preferably from about 10 to about 32% by weight, based upon the total weight of the composition taken as 100% by weight. These phosphate builders can also serve as solidifying agents in the inventive detergent compositions.

Powdered, bead, granular, or liquid non-phosphate builders can also be used in the inventive detergents of the invention. Generally, any water-soluble base is appropriate for the non-phosphate builder, although alkaline builder salts are particularly preferred. For example, preferred non-phosphate builders for use in the inventive detergents are selected from the group consisting of hydroxides, silicates (including metasilicates), carbonates, and the alkali metal salts thereof, and mixtures thereof. More specific examples of suitable non-phosphate builder salts include those selected from the group consisting of alkali metal hydroxides such as sodium hydroxide (i.e., caustic soda) or potassium hydroxide (i.e., caustic potash), sodium or potassium silicate and metasilicate, sodium carbonate (i.e., soda ash) or potassium carbonate, and mixtures thereof. The composition preferably comprises from about 1 to about 50% by weight non-phosphate builder, more preferably from about 3 to about 40% by weight, and even more preferably from about 5 to about 30% by weight, based upon the total weight of the composition taken as 100% by weight. In a particularly preferred embodiment, the detergent compositions comprise at least one phosphate and at least one non-phosphate builder.

Alkali metal hydroxides such as sodium hydroxide, are commercially available as a solid in the form of beads having a mix of particle sizes ranging from about 0.6 to about 0.8 mm. When present, the composition preferably comprises from about 0.1 to about 60% by weight alkali metal hydroxides, more preferably from about 3 to about 50% by weight, and even more preferably from about 5 to about 40% by weight, based upon the total weight of the composition taken as 100% by weight.

A preferred silicate for use in the detergent composition is an aqueous $Na_2SiO_3$ solution (~50%), commercially available under the trade name RU™ from PQ Corporation, Valley Forge, Pa. When present, the composition preferably comprises from about 0.1 to about 50% by weight sodium silicate solution, more preferably from about 3 to about 40% by weight, and even more preferably from about 5 to about 30% by weight, based upon the total weight of the composition taken as 100% by weight.

Sodium metasilicate can also be used in the composition in conjunction with other non-phosphate builders and scale inhibiting agents to produce an effective phosphate-free detergent. The metasilicate is preferably anhydrous. When present in the composition, the sodium metasilicate is preferably utilized at a level of from about 0.1 to about 50% by weight, more preferably from about 3 to about 40% by weight, and even more preferably from about 5 to about 30% by weight, based upon the total weight of the composition taken as 100% by weight.

A preferred carbonate for use in the detergent composition is sodium carbonate dense grade, available from OCT Chemical Corporation, Marietta, Ga. When present, the carbonate is preferably utilized in the composition at a level of from about 0.1 to about 65% by weight, more pretferably from about 3 to about 50% by weight, and even more preferably from about 5 to about 45% by weight, based upon the total weight of the composition taken as 100% by weight.

The detergent composition can also contain a number of optional ingredients including nonionic surfactants, solidifying agents, additional water conditioning agents, soil antiredeposition agents, perfumes, dyes, and combinations thereof.

Suitable nonionic surfactants include those selected from the group consisting of alkyl-capped polyethylene glycol ethers of fatty alcohols, alkyl polyglycosides, alkoxylated ethylene diamine, alcohol alkoxylates (e.g., alcohol ethyoxylate propoxylates, alcohol propoxylates, alcohol ethoxylate butoxylates, nonylphenol ethoxylate, and polyoxyethylene glycol ethers), carboxylic acid esters (e.g., glycerol esters, polyoxyethyle esters, ethoxylated and glycol esters of fatty acids), carboxylic amides (e.g., diethanolamine condensates, monoalkanolamine condensates, and polyoxyethylene fatty acid amides), polyalkyl oxide block copolymers (e.g., ethylene oxide/propylene oxide block copolymer), and combinations thereof. A particularly preferred nonionic surfactant is a polyoxypropylene/polyoxyethylene block copolymer available as PLURONIC® 25R2 from BASF. Another preferred nonionic surfactant is a monofunctional alcohol alkoxylate available as PLURAFAC® RA-43, also from BASF. When present, the composition preferably comprises from about 0.01 to about 10% by weight nonionic surfactant, more preferably from about 0.1 to about 6% by weight, and even more pre ferably from about 1 to about 5% by weight, based upon the total weight of the composition taken as 100% by weight.

As previously mentioned, the phosphate builders listed above can also serve as solidifying agents. Suitable non-phosphate solidifying agents can also be used in the inventive detergent compositions. Preferred non-phosphate solidifying agents comprise inorganic salts and are preferably selected from the group consisting of alkali metal sulfates (e.g., sodium sulfate, potassium sulfate), alkali metal halides (e.g., sodium chloride, potassium chloride), and combinations thereof. When present, the non-phosphate solidifying agent is preferably present in the composition at a level of from about 1 to about 50% by weight non-phosphate solidifying agent, more preferably from about 5 to about 40% by weight, and even more preferably from about 10 to about 30% by weight, based upon the total weight of the composition taken as 100% by weight. In a particularly preferred embodiment, the composition comprises at least one alkali metal sulfate and at least one alkali metal halide. Thus, the composition preferably comprises from about 1 to about 25% by weight alkali metal sulfate, more preferably from about 2 to about 20% by weight, and even more preferably from about 5 to about 15% by weight, based upon the total weight of the composition taken as 100% by weight. The composition also preferably comprises from about 1 to about 40% by weight metal halide, more preferably from about 3 to about 30% by weight, and even more preferably from about 5 to about 20% by weight, based upon the total weight of the composition taken as 100% by weight.

The compositions can also comprise soil antiredeposition agents. Suitable soil antiredeposition agents include carboxymethylcellulose, polvacrylates, and combinations thereof.

In addition to sequestering metal ions, nitrilotriacetic acid and the salts thereof can also be used as a water conditioning agent. Other suitable water conditioning agents include ethylenediaminetetraacetic acid (EDTA), sodium citrate, and maleic anhydride.

Regardless of the embodiment, the inventive detergent compositions are prepared by forming a mixture of the ingredients and allowing the mixture to harden to form a self-sustaining body. Preferably the mixture is homogeneous, and is formed by simply dispersing or dissolving the ingredients in a mixing vessel with a solvent system. The solvent system should be utilized at a level of from about 1 to about 50% by weight, and preferably from about 2 to about 40% by weight, based upon the total weight of the composition taken as 100% by weight. Suitable solvents for use in the solvent system are preferably selected from the group consisting of water, aqueous alkaline solutions, and mixtures thereof. When present, the composition preferably comprises from about 1 to about 30% by weight water, more preferably from about 2 to about 25% by weight, and even more preferably from about 5 to about 20% by weight, based upon the total weight of the composition taken as 100% by weight. When present, the composition preferably comprises from about 1 to about 50% by weight aqueous alkaline solution, more preferably from about 2 to about 40% by weight, and even more preferably from about 5 to about 30% by weight, based upon the total weight of the composition taken as 100% by weight. Preferred aqueous alkaline solutions are selected from the group consisting of strong base solutions such as sodium hydroxide or potassium hydroxide.

The moisture content (from all sources) of the resulting composition is preferably from about 1 to about 50% by weight, more preferably from about 2 to about 40% by weight, and even more preferably from about 5 to about 30% by weight, based upon the total weight of the composition taken as 100% by weight.

The pH of the inventive detergent composition mixture will preferably be greater than about 7, more preferably from about 8 to about 14, and even more preferably from about 12 to about 13.

Regardless of the mixing procedure, the composition can be formed into a self-sustaining body using conventional methods. For example, the composition can be poured into a mold and allowed to harden, preferably at room temperature. The composition will preferably harden into a self-sustaining body in about 1-48 hours, and preferably about 24 hours at ambient conditions (i.e., room temperature, about 20-28° C.). The solid detergent composition should have a moisture content of less than about 50% by weight, preferably from about 2 to about 40% by weight, and more preferably from about 5 to about 30% by weight, based upon the total weight of the solid taken as 100% by weight.

The final solid detergent is a homogeneous, self-sustaining (i.e., monolithic) body, as distinguished from powder, granule, or particulate forms. That is,the solid retains a particular shape once that shape is formed and is not susceptible to deformation merely due to its own internal forces. In a preferred embodiment, the self-sustaining body in the shape of a cylinder and has an average height of at least about 6.5 inches, more preferably from about 6.5 to about 7 inches, with a diameter of at least about 5 inches, more preferably from about 5 to about 6 inches. It is preferred that the final detergent block, tablet, or otherwise shaped self-sustaining body, has an average weight of at least about 7 lbs., more preferably from about 7 lbs to about 9 lbs., and most preferably about 8 lbs. Furthermore, the specific gravity of the body is preferably from about 1 to about 2, more preferably from about 1.30 to about 1.70, and most preferably about 1.53. The solid detergent also has a shelf life stability of at least about 12 months, preferably at least about 24 months when stored at ambient temperature conditions as defined herein. Shelf life stability is defined herein to mean the time period during which the solid detergent maintains its overall compositional stability. That is, there are no reactions among the ingredients, no decrease in efficacy, and the integrity of the self-sustaining body is retained (i.e., it does not crumble, etc.). The cleaning performance of the detergent is guaranteed when used before expiration of the shelf life.

It will be appreciated that the detergent compositions are highly soluble in water. That is, the detergent compositions are at least about 95%, preferably at least about 98%, and even more preferably about 100% dissolved in water within about 5 seconds to 2 minutes, preferably within about 45 to about 60 seconds after combining with water (preferably at a temperature of from about 145-170° F. (62.78-76.67° C.), and more preferably from about 150-165° F. (65.56-73.89° C.)).

It will be appreciated that the composition described above can be dissolved or dispersed in a solvent system such as water at the time of use, for example in a method of removing soils from a substrate. The method involves forming a wash solution by dissolving or dispersing the inventive solid detergent composition in water, contacting soils on the substrate with the wash solution, removing the soils, and rinsing the substrate without the use of a rinse additive. The term "rinse additive" or "agent," as used herein is intended to refer to any compounds used during the rinse cycle to facilitate drying time, reduce spotting, etc. on solid surfaces, and typically include one or more block polymers and co-polymers. These compounds cause water to sheet off of the surface being rinsed. This sheeting action reduces drying time of the surface. They are usually in the form of a liquid, although some solids are available, and must be added as part of the rinse cycle. Examples of such rinse additives include JET-DRY® and ELECTRASOL® (both Reckitt Benckiser, Netherlands), Dry it Plus™ and Dry it Low™ (both Noble Chemical, Lancaster, PA), Low Temp Rinse Aid™ (Advantage Chemicals, England), and MCS-248 Solid Rinse Additive (Noramtech, Kansas City, Kans.).

Preferably the use concentration of the detergent in the wash water solution will be at least about 0.05 oz./gal., more preferably from about 0.05 to about 0.3 oz./gal., and even more preferably from about 0.12 to about 0.25oz./gal., based upon the total volume of the wash solution. Any suitable method of measuring the concentration of the detergent in the wash solution can be used. For example, drop count titration can be used to measure the concentration of the detergent by measuring the standard concentration of a known reagent (i.e., an acid) that chemically reacts with the detergent. A chemical indicator can be used to determine when the reaction that occurs is complete or is brought to a certain degree of completion, referred to as the end point, or more technically the equivalence point. For example, the concentration of the detergent is measured by taking, as a sample, an aliquot of 10 ml of the wash solution (detergent dispersed or dissolved in water). Three drops of an indicator, such as phenolphthalein, are added to the solution imparting a red color. The solution is then titrated by adding a predetermined concentration of acid solution drop-by-drop until the color disappears. In the present invention, 16 drops of 0.1N (normal) HCl will equilibrate to a concentration of approximately 0.25 ounces of detergent per gallon of wash solution. Thus, as noted above, the most preferred use range of the inventive detergent is from about 0.12 to about 0.25 ounces of detergent per gallon of wash solution, or about 8 to 16 drops of 0.1N acid (preferably HCl) using a 10 ml sample of wash solution and 3 drops of phenolphthalein indicator.

In a preferred embodiment, the method of using the solid detergent involves inserting the inventive solid composition into a dispenser located in or associated with a dishmachine. Exemplary dispensers may be used with any variety of dishmachines, such as conveyor machines, under-the-counter dishmachines, bar washers, door machines, flight machines, etc. The dispenser may be located integral to the dishmachine itself, or it may be separate and mounted remotely from or outside of the dishmachine. Preferably, the dispenser includes a dosage controller. Once the inventive solid detergent composition is inserted into the dispenser, the wash cycle of the dishmachine is started and a wash solution is formed. The wash solution comprises the inventive solid detergent composition and water from the dish machine. The water may be any type of water including hard water, soft water, distilled water, clean water, or dirty water. The most preferred wash solution is one that maintains the preferred pH ranges of at least about 7, more preferably from about 8 to about 14, and most preferably from about 12 to about 13. The wash solution contacts the soils on the substrate surface (e.g., serviceware) in the dishmachine. Preferably, the wash solution is heated to a temperature of from about 100° F. (37.78° C.) to about 160° F. (71.1 ° C.) prior to or simultaneous with the step of contacting the soils on the substrate surface. These soils include food soils (e.g., protein soils, fatty soils, carbohydrate soils), hard water residue (e.g., mineral deposits, films, particles, flecks), as well as lipstick and other similar emollients, oils, etc. Serviceware that can be cleaned includes articles made of glass, plastic, metal (e.g., aluminum, stainless steel, copper), rubber (e.g., silicon), ceramic, wood and combinations thereof. The term "serviceware," as used herein, refers to all foodservice-related items, including glassware, flatware (e.g., forks, spoons, knives), tableware (e.g., bowls, plates), pots and pans, trays, bakeware (e.g., cookie sheets), as well as cooking and serving utensils (e.g., wooden spoons, spatulas, rubber scrapers). The wash solution may contact the soil in a variety of ways including spraying, dipping, dunking, misting, soaking, mechanical contact (i.e., manual scrubbing), and combinations thereof.

Contact by the wash solution with the soil removes the soil from the serviceware. Once the soil is removed, the serviceware is rinsed as part of the dishmachine rinse cycle, without the use of a rinse additive, as that term is defined above. Preferably, the water is heated to a temperature of at least about 180° F. (82.2° C.) during rinsing. The serviceware is then allowed to dry, preferably under ambient conditions and with no active drying action or contact such as hand towel drying, forced air, heat lamp, etc. It will be appreciated that the above method can include additional steps depending on the particular wash cycle of the dishmachine being used. The method could also include fewer steps, such as not having a separate rinse cycle at the end. However, a separate rinse additive is not needed to achieve satisfactory cleaning performance, and is preferably avoided.

The inventive detergent decreases drying time of the serviceware, such that serviceware cleaned using the inventive solid detergent will dry automatically (i.e., be free of residual water from the washing or rinsing step) within less than about 60 seconds after rinsing with water at a temperature of at least about 180° F. (82.2° C.) and no separate rinse additive. Preferably, the serviceware will be dry within about 30 to about 60 seconds after rinsing, when allowed to dry under ambient conditions. Advantageously, the inventive solid detergent compositions also help prevent mineral scale from building up on cleaning equipment and promotes the rinsing of any residual water hardness from the serviceware, as well as on the internal parts of the dishmachine.

EXAMPLES

The following examples set forth preferred methods in accordance with the invention. It is to be understood, however, that these examples are provided by way of illustration and nothing therein should be taken as a limitation upon the overall scope of the invention.

Example 1

Preparation of Formulation

In this Example, a detergent formulation was prepared from the ingredients listed in Table 1 below.

TABLE 1

| INGREDIENT | % BY WEIGHT |
|---|---|
| Water | 5.0 |
| NaOH solution (50%) | 30.0 |
| Amino Tri (methylene phosphonic acid)[A] | 1.0 |
| Sodium Hydroxide beads[B] | 12.0 |
| Salt[C] | 11.5 |
| Sodium Sulfate | 2.0 |
| Polyoxypropylene-polyoxyethylene block copolymer[D] | 1.5 |
| DADMAC/acrylic-based copolymer[E] | 1.0 |
| Sodium polyacrylate[F] | 4.0 |
| Sodium tripolyphosphate | 32.0 |

[A]DeQuest ® 2000 (aqueous solution of amino tri(methylenephosphonic acid) and phosponic acid); available from Thermphos Trading GmbH, Switzerland.
[B]Available from Fisher Scientific, Fairlawn, NJ.
[C]Sodium chloride.
[D]Pluronic ® 25R2 Nonionic Surfactant; available from BASF, NJ.
[E]Mirapol Surf-S 210; available from Rhodia, Cranbury, NJ.
[F]Acusol ™ 445N; available from Rohm and Haas, Philadelphia, PA.

The detergent formulation was prepared by adding each of the ingredients above to a mixing vessel with continuous mixing at room temperature. The mixture was then allowed to sit at room temperature for approximately 24 hours until hardened into a solid.

Example 2

Formulation Testing

In this Example, the solid detergent prepared in Example 1 above was tested for efficacy using commercial dishmachines at two separate restaurants.

1. Barbeque Restaurant

The first restaurant was a barbeque restaurant, which used a high temperature dishmachine (Hobart AM 14-series Warewasher) equipped with a Viking solid bowl type detergent dispenser, a Dema Chemaster dosage controller, and a water softener. Prior to washing, the water hardness was adjusted to 0 grains Ten drinking glasses that had been previously washed in the dishmachine using a commercially-available detergent were washed using the solid detergent prepared in Example 1 above. Prior to washing with the inventive detergent formulation, the glasses were recorded as being hazy in appearance. The glasses were then run in the dishmachine on a single wash cycle with the inventive detergent formulation for approximately 45 seconds, at a use concentration of about 0.25 oz./gal. of wash water, as determined by the titration method previously described herein. After washing, the glasses were removed from the dishmachine and observed to be very clear and completely spot-free. The previously observed hazing had been removed, and no separate rinse additive was required. Next, stainless steel flatware was washed in the commercial dishmachine using the same procedures outlined above. As with the glasses, after washing, the flatware was removed from the dishmachine and observed to be very bright and clean with no streaks or spots. Again, no separate rinse additive was required.

On a separate occasion, an array of serviceware was again washed at the barbeque restaurant using the inventive solid detergent. Prior to washing, the serviceware was recorded as being greasy and dirty with heavy food soils. The serviceware was then run on a single wash cycle in the dishmachine for approximately 45 seconds, followed by a rinse for approximately 10 seconds. The inventive detergent was titrated approximately 9 drops until clear (a use concentration of about 0.141 oz./gal.), as determined by the titration method described herein. No rinse additive was used. The parameters for the test wash are provided in Table 2 below.

TABLE 2

| Parameter | Dishmachine Setting |
|---|---|
| Pre-wash Temperature | N/A |
| Wash Temperature | 165° F. |
| Pre-Rinse Temperature | N/A |
| Rinse Temperature | 184° F. |
| Rinse Pressure | 20 psi |

After the test wash, the serviceware was evaluated to determine the effectiveness of the inventive solid detergent. The recorded results are provided in Table 3 below.

TABLE 3

| Serviceware | Results |
|---|---|
| Dishes | Squeaky clean, no spots, no film or residue |
| Glassware | Completely clear, sparkling, no spots, no residue around rim |
| Flatware | Completely clear, no spots, gleaming |
| Trays | Completely clean, no film or residue |
| Coffee cups | Completely clean, clear, no spots, no residue around rim |
| Pots/Pans | Completely clean |

The inventive detergent was tested at the barbeque restaurant a third time to compare it to a commercially available detergent. First, a commercially available detergent (37% caustic, 2% chlorine solid) was used to wash the serviceware. The detergent was titrated approximately 10 drops until clear (about 0.20 oz. detergent per gallon of wash water). The rinse pump speed was set on setting 4 (approximately 2-3 min.) and a 30% solid rinse additive (rinse aid) was set to be automatically injected (via the rinse pump) into the rinse water during the last 4 seconds of the rinse cycle (according to the normal dishmachine procedures). The parameters for the test wash are set forth in Table 4 below.

TABLE 4

| Parameter | Dishmachine Setting |
|---|---|
| Pre-wash Temperature | N/A |
| Wash Temperature | 158° F. |
| Pre-Rinse Temperature | N/A |
| Rinse Temperature | 189° F. |
| Rinse Pressure | 20 psi |

After the final rinse, the serviceware was observed to evaluate the cleaning performance of the detergent. The overall results were reported marginal. The drying time on the glassware and stainless steel flatware was recorded to be about 1.5 minutes, and the drying time of the plates, platters, and coffee cups was recorded to be about 1 minute. Translucent particles or flecks were reported on the inside of the glassware and water spots were reported on the flatware.

Next, the rinse pump was turned off (to prevent any rinse additive from being injected into the rinse cycle) and the inventive solid detergent was installed in the dishmachine for automatic dispensing. The titration was set at 16 drops until clear (approximately 0.25 oz./gal. wash water), as determined by the titration method described herein. The remaining parameters (Table 3) of the wash remained the same. The overall cleaning performance was dramatically improved over the commercially-available detergent and rinse additive. The drying time of the glassware was recorded to be about 40 seconds, while the drying time of the stainless steel flatware was recorded to be about 30 seconds or less. The drying time of the plates, platters, and coffee cups was recorded to be about 15 seconds. The inside and outside of the glassware was reported to be spotless and streak free with no residue, translucent particles, or flecks. The rest of the serviceware was also reported to be streak free and shining.

2. Country Club Restaurant

The second restaurant was a country club restaurant, which used a high temperature dishmachine (Hobart CL 44E-series Warewasher) equipped with a Viking PRO III solid bowl type detergent dispenser, Dema Chemaster dosage controller, and a water softener. Prior to washing, the water hardness was adjusted to 0 grains.

An array of serviceware was washed using the inventive solid detergent. The serviceware was run on a single wash cycle in the dishmachine, followed by a rinse. The solid was titrated 13 drops until clear (a use concentration of about 0.20 oz./gal), as determined by the titration method described herein. No rinse additive was used. The parameters for the test wash are provided in Table 5 below.

TABLE 5

| Parameter | Dishmachine Setting | Cycle Time (Seconds) |
|---|---|---|
| Pre-wash Temperature | N/A | N/A |
| Wash Temperature | 163° F. | 45 |
| Pre-Rinse Temperature | N/A | N/A |
| Rinse Temperature | 193° F. | 10 |
| Rinse Pressure | 20 psi | N/A |

After the test wash, the serviceware was evaluated by the technician to determine the effectiveness of the inventive solid detergent. The overall cleaning performance of the dishes, glassware, flatware, and pots/pans were all recorded as receiving the highest marks. The general sanitation of the test wash was also recorded as being good.

I claim:

1. A method of removing soils from a substrate surface comprising:

providing a substrate having a surface with soils thereon;

dissolving or dispersing a solid detergent composition in water to form a wash solution, said detergent composition being in the form of a homogeneous, self-sustaining body formed by mixing ingredients with a solvent system, and allowing the mixture to harden to form said homogeneous, self-sustaining body, said ingredients comprising:

a copolymer of a quarternary ammonium compound and a comonomer selected from the group consisting of acids, acrylamides, and combinations thereof;

a scale inhibiting agent; and a non-phosphate builder; and said homogeneous, self-sustaining body comprising a moisture content of from about 2 to about 40% by weight, based on the total weight of the self-sustaining body taken as 100% by weight;

contacting said substrate surface with said wash solution;

removing the soils from said substrate surface; and rinsing said substrate without the use of a rinse additive.

2. The method of claim 1, wherein the concentration of said detergent in said wash solution is at least about 0.05 oz./gal., based upon the total volume of the wash solution.

3. The method of claim 1, wherein said wash solution has a pH of greater than about 7.

4. The method of claim 1, wherein said wash solution is heated to a temperature of from about 1009° F. to about 160° F. prior to said contacting.

5. The method of claim 1, further comprising drying said substrate surface under ambient conditions within less than about 60 seconds after said rinsing.

6. The method of claim 1, said substrate being selected from the group consisting of glass, plastic, metal, rubber, ceramic, wood and combinations thereof.

7. The method of claim 1, wherein said self-sustaining body has an average height of at least about 6.5 inches and an average width of at least about 5 inches.

8. The method of claim 1, wherein said self-sustaining body has an average weight of at least about 7 lbs.

9. The method of claim 1, wherein said composition comprises from about 0.5% to about 5% by weight of said copolymer, based upon the total weight of the composition taken as 100% by weight.

* * * * *